United States Patent [19]

Widdowson

[11] 3,953,984

[45] May 4, 1976

[54] PILOTED THROTTLING VALVE

[75] Inventor: Richard E. Widdowson, Dayton, Ohio

[73] Assignee: General Motors Corporation, Detroit, Mich.

[22] Filed: Feb. 12, 1975

[21] Appl. No.: 549,392

[52] U.S. Cl. ..... 62/156; 62/196; 251/45; 236/86

[51] Int. Cl.[2] ..... F25D 21/00; F16K 31/12

[58] Field of Search ..... 62/196, 156, 217; 236/93, 86; 251/45; 137/489

[56] References Cited

UNITED STATES PATENTS

| | | | |
|---|---|---|---|
| 917,443 | 4/1909 | Jahn | 137/489 |
| 925,812 | 6/1909 | Jahn | 137/489 |
| 3,338,517 | 8/1967 | Katchka et al. | 137/489 X |
| 3,580,500 | 5/1971 | Quinn | 236/12 |
| 3,808,830 | 5/1974 | Atkinson et al. | 62/217 |
| 3,834,175 | 9/1974 | Jones et al. | 62/196 |

*Primary Examiner*—William E. Wayner
*Attorney, Agent, or Firm*—K. H. MacLean, Jr.

[57] ABSTRACT

A refrigerant control valve for air conditioning systems of the hot gas bypass type including a bypass passage between the compressor outlet and the evaporator inlet through which refrigerant flow is regulated by a pressure operated valve member one side of which is exposed to compressor outlet pressure and the other side of which is exposed to refrigerant pressure in a control chamber. The control chamber is connected by a bleed passage to the compressor inlet and a Schrader-type bleed valve therein to allow the discharge of refrigerant from the control chamber when open so that an opening pressure differential is established across the valve when the bleed valve is open. A sensor-actuator for the bleed valve is supported near the evaporator outlet in the refrigerant flow therefrom and includes a housing with a rigid wall and a movable wall which encloses an interior space filled with water. The movable wall is supported adjacent to the bleed valve so that when freezing temperatures are sensed, ice formation proceeds to move the movable wall against the bleed valve and open it which reduces the pressure of the control chamber and opens the bypass valve.

2 Claims, 1 Drawing Figure

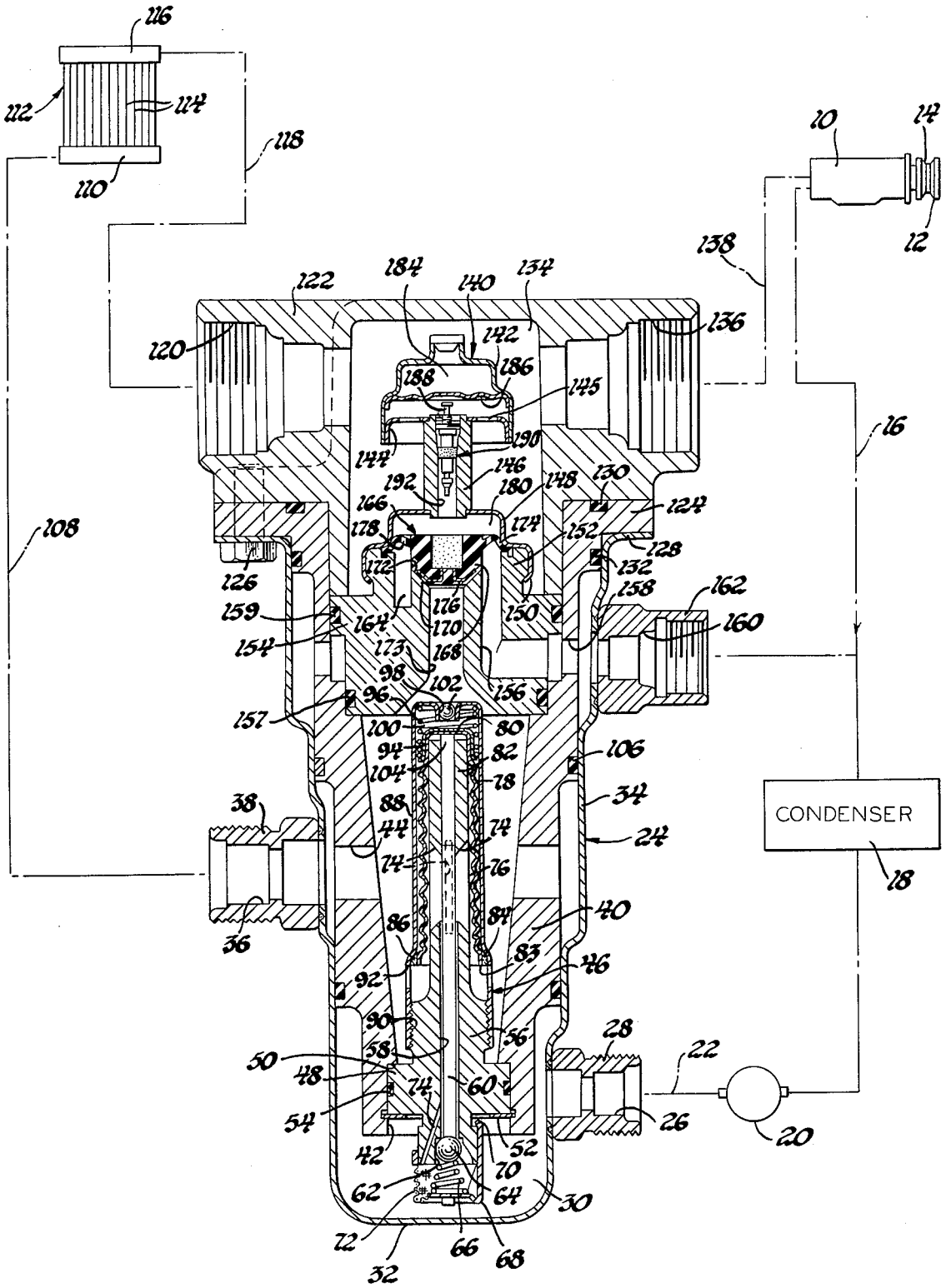
CONDENSER

PILOTED THROTTLING VALVE

This invention relates to a refrigerant control valve for an air conditioning system and more particularly to a freeze-actuated valve for controlling the passage of refrigerant from the compressor directly to the evaporator in bypass relation to the condenser.

Previous automotive air conditioning systems have utilized bypass valves for routing hot refrigerant directly from the compressor to the evaporator to mix with relatively cool refrigerant therein for controlling evaporator temperature. The use of bimetal type temperature sensors and actuators is common. The present invention proposes the use of a sensor-actuator enclosing a sealed quantity of water. Upon freezing the water expands to move a portion of the actuator which engages a Schrader-type bleed valve to control the pressure in a control chamber located above a pressure operated bypass valve member. Opening of this valve allows refrigerant to pass directly from the compressor into the evaporator. The sensor-actuator includes a housing with a flexible wall enclosing a charge of water. Upon freezing of the water, the diaphragm portion is moved toward the Schrader valve to open it and reduce the pressure in the control chamber. The pressure decrease in the control chamber opens the bypass valve and passes hot refrigerant to the evaporator which causes its temperature to increase.

A movable valve member of molded polymeric material controls the flow of hot bypass refrigerant. It has a central portion with inclined surfaces coactive with similarly formed valve seat surfaces on the housing to control refrigerant flow thereby. Extending from the valve's central portion is a relatively thin diaphragm portion which is supported by the housing at its outer edge to allow the center portion to move with respect to the valve seat. An annular reinforcing member is molded into the central portion of the polymeric valve to impart a degree of rigidity.

Therefore, an object of the present invention is to provide a simple, and compact bypass type valve assembly to direct refrigerant flow from the compressor to the evaporator in bypass relation to the condenser and expansion means in response to ice formation within a housing exposed to refrigerant discharged from the evaporator.

A further object of the present invention is to provide a simple and compact refrigerant bypass valve assembly controlled by a freeze sensor-actuator which operates a Schrader-type bleed valve upon exposure to refrigerant temperatures below 32°F.

A still further object of the present invention is to provide a simple and compact refrigerant bypass valve assembly including a valve member of polymeric material having a central portion with inclined valving surfaces thereon and thin edge portions supported by a valve housing to permit the center portion to move in response to a pressure differential across the valve.

Further objects and advantages of the present invention will be more readily apparent from the following detailed description, reference being had to the accompanying drawing, in which a sectioned view of a preferred embodiment of the subject control valve is illustrated in flow relationship to other air conditioning components.

An air conditioning system is illustrated including a refrigerant compressor 10. The end of a drive shaft (not visual) of the compressor 10 is connected to a pulley assembly 12 which is adapted to be driven by the engine of an automobile by a V belt (not shown) extending through groove 14 of the pulley 12. The outlet of compressor 10 is connected by a conduit 16 (shown schematically) to the inlet of a condenser 18. The condenser 18 is a conventional tube and fin type heat exchanger and is normally located near the front of the automobile where it is exposed to the flow of air through the grill for cooling and liquefying warm refrigerant therein. The outlet of the condenser 18 is fluidly connected to a receiver-drier assembly 20 which provides storage for excess refrigerant in the system. The receiver-drier also separates vaporous from liquid refrigerant and passes the latter through a conduit 22 to a control valve assembly 24.

The control valve assembly 24 has an inlet 26 formed by a fitting 28. The inlet communicates with a chamber 30 defined by the lower portion 32 of a housing member 34. An outlet opening 36 is formed by a fitting 38 which is attached to housing member 34 and is separated from chamber 30 by an interior partition member 40. Openings 42 and 44 in partition member 40 pass refrigerant between the inlet 26 and the outlet 36.

An expansion valve assembly 46 is supported by the partition member 40 and specifically includes an enlarged diameter portion 48 held in an axial direction within opening 42 by a shoulder portion 50 and a radially expandible retainer 52. An O-ring seal between the members 40 and 48 prevents fluid leakage therebetween. The expansion valve assembly 46 includes a member 56 with an axially extending bore 58 therein. Slidably supported within the bore 58 is a metering rod 60 defining a restricted annular passage therebetween. The lower end of member 56 has a recess 62 formed therein in which a ball valve member 64 is located. The valve 64 is held against the end of housing 56 by a coil spring 66 which extends from a combination screen support and retainer member 68. Member 68 has a plurality of fingers which extend around the end of member 56 and are crimped thereover at 70. Member 68 also supports a screen type filter 72 to prevent foreign particles from entering the passage between rod 60 and bore 58. A passageway 74 in member 56 is provided in bypass relationship to the valve 64 to provide a minimal flow of refrigerant at all times.

The rod 60 extends upward through the member 56 and past ports 74 therein which permit refrigerant to flow from the passage between members 56 and 60 to the interior 76 of a bellows 78. The bellows 78 has a closed end 80 which covers the end 82 of member 56. The lower end of the bellows 78 is open and has a bottom end 83. Solder 84 fills the space between a shoulder 86 on member 88 and the end 83 of bellows 78. In this way, bellows 78 is fixedly attached to the member 88 to prevent relative movement of the bottom end 83. A threaded lower portion 90 of member 88 is threadably secured to member 56. Openings 92 in member 88 permit refrigerant to flow from the ports 74 downward through the interior 76 of the bellows 78 to opening 44 in partition member 40 before discharge through outlet 36. The closed end 80 of the bellows 78 is capped by spring retainer 94 which supports one end of a spring 96. The other upper end of spring 96 engages the end of member 88. An opening 98 in the end of member 88 is used to evacuate the space 100 between member 88 and the bellows 78. A ball is forced in the opening 98 and soldered or brazed therein to seal the evacuated space 100.

In operation, the pressure of refrigerant within the interior 76 of the bellows produces an extending force on the bellows to move end 80 upwards and downwards against the spring 96 in response to changes in the pressure differential between bellows interior 76 and the space 100. This movement of the bellows causes end 80 to axially position the end 104 of metering rod 60. Downward movement of rod 60 from the position shown in the drawing in response to a pressure decrease in the evaporator will unseat the valve 64 and increase refrigerant flow through the restrictive passage between bore 58 and rod 60. An increase in the aforesaid pressure will move rod 60 upward and limit refrigerant flow through the expansion valve and into the evaporator. An O-ring 106 between members 40 and 32 prevents fluid leakage therebetween.

Refrigerant pssses from the outlet 36 of the control valve assembly 24 through a conduit 108 to the lower header 110 of an evaporator 112. The evaporator 112 has a plurality of finned tubes or conduits 114 which connect the lower header tank 110 to an upper header tank 116. The evaporator 112 is adapted for placement within the air stream of an air distribution ducts of the automobile's heating and cooling system. Air passing into the passenger compartment through the duct first passes over the tubes 114 and has heat extracted from the air. This extraction of heat from the air by the refrigerant causes liquid refrigerant within the evaporator to vaporize and be discharged through a conduit 118. The refrigerant passes into an inlet 120 of an upper housing member 122 of the control valve assembly 24. The housing 122 is attached to a flange portion 124 of member 40 by fasteners 126. The fasteners 126 also secure portion 128 of member 34. O-rings 130 and 132 prevent fluid leakage between the members 34, 40 and 122.

The housing 122 has an interior space 134 extending between inlet 120 and an outlet 136. Refrigerant discharged from outlet 136 then flows through a conduit 138 to the inlet of the compressor 10 to complete a closed refrigerant flow cycle.

A temperature responsive sensor and actuator 140 is located within the chamber 134 of housing 122. The sensor-actuator 140 is formed by an inverted cup-shaped member 142 whose edge is attached to a member 144 to support the sensor-actuator 140 within chamber 134. Member 144 has openings 145 therethrough and is attached to the end of a tubular support member 146 the other end of which is attached to a control chamber housing 148. Housing 148 has a turned down edge portion 150 which encircles a collar 152 of a bypass housing member 154. Housing 154 includes an inlet passage 156 which is connected to a port 158 in member 40 and to a hot gas inlet 160 formed by a fitting 162. O-rings 157 and 159 prevent fluid leakage between members 40 and 154.

The passage 156 flows hot vaporous refrigerant from the compressor to an annular chamber 164 surrounding a movable diaphragm type valve member 166. The diaphragm 166 is of molded polymeric material and includes a rigid central portion 168 which has a conically shaped or inclined valve surface 170 thereon. A similarly configured valve seat portion 172 on member 154 surrounds an opening 173 in housing 154 which is connected to the evaporator inlet. Diaphragm valve 166 further includes a relatively thin and thereby flexible peripheral edge portion 174 which is grippingly engaged between member 148 and the collar 152 to support the diaphragm 166. The central hub portion 168 of the diaphragm member 166 includes an imbedded annular reinforcing collar 176 near the valve surface 170.

The edge portion 174 of the diaphragm valve 176 has a restricted orifice means or openings 178 between the annular chamber 164 and a control chamber 180 located between member 148 and the diaphragm valve 166. Normally, the passage 156 and orifice 178 pressurize the control chamber 180 to produce a closing downward force against the diaphragm valve 166 to block opening 173 and prevent the passage of hot vaporous refrigerant into the evaporator.

Operation of the aforedescribed air conditioning system on a relatively low temperature spring or fall day, the air passing over the finned tubes 114 of evaporator 112 may not give up sufficient heat to vaporize the quantity of liquid refrigerant supplied by the compressor. Under these conditions, the temperature of refrigerant discharged from the evaporator and entering chamber 134 is decreased. The sensor-actuator 140 includes a water-filled space 184 formed between member 142 and a flexible diaphragm 186. The formation of ice in space 184 causes the water to expand and move the diaphragm wall 186 downward against the stem 188 of a Schrader-type valve 190. Schrader-type valves are well known to the manufacturing community and are most commonly used as tire valves. Basically they are poppet type valves operated by depression of the stem portion. The valve 190 normally blocks the passage of refrigerant from chamber 180 and thus maintains a relatively high pressure therein. The use of a Schrader-type valve in a hot gas temperature control or hot gas defrost system is unique and offers definite advantages over other type valves. Its operation is simple and it is durable. The ready availability of the valve and its low cost are also very desirable.

When diaphragm wall 186 moves to open valve 190, refrigerant passes through bleed passage 192 into the chamber 134 and the pressure of control chamber 180 is rapidly decreased. This reduction of pressure in control chamber 180 permits the pressure differential between chambers 164, 180 to lift the diaphragm valve 166 upward and to allow a flow of hot vaporous refrigerant into the evaporator via opening 173. The resultant mixture of hot and cold refrigerant increases the temperature in the evaporator to prevent frost from forming on its external finned surfaces.

The warming of the evaporator will tend to melt the ice within sensor-actuator 140 and permit the Schrader valve 190 to close. The resultant pressure increase in chamber 180 then causes diaphragm valve 166 to again block opening 173 to cut off the flow of hot refrigerant to the evaporator.

Although the aforedescribed embodiment of the invention is a preferred embodiment, other embodiments may be adapted without falling outside the scope of the following claims which specifically point out and describe the invention.

What is claimed is:

1. A bypass type control valve for an air conditioning system having an evaporator and a compressor comprising:

a valve housing defining a flow passage with an inlet adapted to be fluidly connected to the evaporator and an outlet adapted to be fluidly connected to the compressor;

said housing further having a bypass passage with an inlet fluidly connected to compressor and an outlet fluidly connected to the evaporator for passage of warm fluid from the compressor directly to the evaporator to increase the evaporator temperature;

said bypass passage having a valve seat therein and a valve member coacting therewith to regulate the flow of warm fluid therethrough;

said valve member having a central portion with a valving surface thereon to engage said valve seat and a thin walled and resilient peripheral edge portion extending integrally therefrom and supported at a radially outer edge by said housing to permit movement of said central portion with respect to said outer edge, thereby controlling fluid flow through said bypass;

enclosure forming means including a member extending in overlying relation to one side of said valve member defining a pressure control chamber on said one side of said valve member and having a bleed passage formed therein connecting said control chamber with said flow passage;

said valve member having a restricted aperture extending through said peripheral edge portion of said valve member fluidly connecting said control chamber with the compressor to pressurize said control chamber and create a closing force on said valve member, thus blocking fluid flow through said bypass passage;

a Schrader-type bleed valve supported by said enclosure forming means in said bleed passage and regulating the flow of fluid from said bypass inlet, through said aperture and said control chamber to said flow passage to permit selective depressurization of said control chamber and removal of the closing pressure force on said valve member to open said bypass passage;

said Schrader-type bleed valve having a projecting stem portion operably connected to a valving portion so that the valve is opened when the stem portion is moved inwardly toward the valve;

a temperature sensor and valve actuator within said flow passage including a rigidly walled portion and a thin, movable wall which define a sealed interior space filled with water to cause outward movement of said movable wall upon freezing of said water;

said temperature sensor valve actuator being supported at a peripheral edge of said rigid wall portion with said movable wall adjacent said stem portion of the Schrader-type bleed valve so that with movement of said wall upon freezing of said water said bleed valve is opened to depressurize said control chamber and open said bleed passage to flow of warm fluid into said evaporator.

2. An improved fluid control valve assembly for an air conditioning system having an evaporator and a compressor comprising: the valve assembly includes a generally cup-shaped housing portion with an outwardly directed edge portion encircling its open end and with fluid inlet and outlet means therethrough adapted to be connected in fluid flow relation between said compressor and said evaporator, respectively, for passing refrigerant through the interior of the housing; a generally cup-shaped partition member extending into the hollow interior of the housing and into engagement therewith between said inlet and outlet means, thereby separating the inlet and outlet; said partition member having an outwardly directed end portion extending in overlying relation to said edge portion of said housing for positioning said members with respect to one another; expansion valve means supported within said partition member between said inlet and said outlet to provide passage means for fluid therebetween for the purpose of controlling fluid flow and decreasing fluid pressure from said inlet to said outlet; a bypass valve housing insertably supported within the interior of said cup-shaped partition member with a first passage therein aligned with a bypass inlet means in said partition member and said housing to pass relatively warm refrigerant from said compressor inlet; said bypass housing also having an axially extending outlet passage formed therein in fluid communication with the inlet of the evaporator; a valve seat portion formed by said bypass housing encircling said bypass outlet; a valve member of elastomeric material having a central valving portion conforming to the shape of said valve seat portion and adapted to normally engage the valve seat to prevent passage of refrigerant thereby; said valve member having an integrally formed peripheral edge portion which is relatively thin and resilient; said peripheral edge portion of said valve member being supported at its outer edge by said bypass housing to permit axial movements of said central portion from said valve seat portion, thereby regulating the flow of hot refrigerant from the compressor to the evaporator; a generally cup-shaped enclosure member with an outwardly directed peripheral edge portion extending in overlying relation with said bypass housing and the peripheral edge of said valve member, thereby securing said peripheral edge portion; a mid-portion of said enclosure member overlying in spaced relation the central portion of said valving member and defining a pressure control chamber therebetween; a small orifice extending through the peripheral edge portion of said valving member to interconnect said bypass inlet with said control chamber, thereby permitting passage of relatively high pressure refrigerant thereto to bias the valve member into a closed position engaging the valve seat of the bypass housing; a bypass bleed valve assembly supported by said enclosure member and including a tubular housing, one end of which is attached to the mid-portion of the enclosure member to form a passage leading from said pressure control chamber; a Schrader-type valve member supported within the tubular housing and having a stem portion extending axially from the end portion of the tubular member to permit opening of the bleed passage to flow from the pressure control chamber when the stem portion is depressed; a suction line housing member having an inlet and an outlet adapted to be connected respectively to the evaporator outlet and the compressor inlet; said suction line housing member having a portion overlying said outwardly directed edge portion of said partition member to permit assembly of said control valve by fastener means engaging the edge portions of said housing, said partition member and said suction line housing member; a portion of said suction line housing member engaging said bypass housing to axially retain said bypass housing within said partition member; said suction line end member defining an interior space between its inlet and outlet which encloses said control chamber forming member and said tubular member for the passage of refrigerant thereby from the evaporator to the compressor; a freeze-type sensor-actuator with a rigid-walled portion supported at a peripheral edge by said tubular housing and with a relatively thin and resiliently movable wall portion attached to the rigid-walled portion in spaced relation thereto to define a low volume interior space filled with water so that when the temperature of adjacent refrigerant falls below about 32°F., the water will freeze and expand, thereby causing the resilient-walled portion of the sensor-actuator to move from said rigid-walled portion and engage the stem portion of said Schrader-type valve, thereby causing depressurization of said pressure control chamber by flow of refrigerant therefrom into said suction line which produces a force on the valve member to move the central portion away from the valve seat portion of the bypass housing, thus permitting hot refrigerant to flow into the evaporator for defrosting purposes.

* * * * *